US011255519B1

(12) United States Patent
Klus

(10) Patent No.: US 11,255,519 B1
(45) Date of Patent: Feb. 22, 2022

(54) DUAL EXTRUSION SYSTEM FOR LED LIGHT FIXTURE

(71) Applicant: KLUS, LLC, Vero Beach, FL (US)

(72) Inventor: Sylwester Klus, Kamionka (PL)

(73) Assignee: KLUS, LLC, Vero Beach, FL (US)

( * ) Notice: Subject to any disclaimer, the term of this patent is extended or adjusted under 35 U.S.C. 154(b) by 0 days.

(21) Appl. No.: 17/368,057

(22) Filed: Jul. 6, 2021

(51) Int. Cl.
*F21V 19/00* (2006.01)
*F21S 4/28* (2016.01)
*F21Y 115/10* (2016.01)

(52) U.S. Cl.
CPC ..... *F21V 19/004* (2013.01); *F21S 4/28* (2016.01); *F21Y 2115/10* (2016.08)

(58) Field of Classification Search
CPC ..... F21V 19/004; F21S 4/28; F21Y 2115/10
USPC ..... 362/217.1
See application file for complete search history.

(56) References Cited

U.S. PATENT DOCUMENTS 5,160,202 A 11/1992 Legare
5,481,443 A 1/1996 Wagner et al.
5,810,468 A 9/1998 Shimada
6,354,714 B1 3/2002 Rhodes
6,481,130 B1 11/2002 Wu
6,561,690 B2 5/2003 Balestriero et al.
7,322,714 B2 1/2008 Barnett et al.
7,553,042 B2 6/2009 Hagen
7,673,841 B2 3/2010 Wronski
8,231,243 B1 7/2012 Boissevain et al.
8,267,540 B2 9/2012 Klus
8,439,531 B2 5/2013 Trott et al.
8,459,824 B1 6/2013 Esmailzadeh
8,616,757 B2 12/2013 Leadford et al.
8,628,212 B2 1/2014 Klus
8,651,689 B2 2/2014 Que
8,764,220 B2 7/2014 Chan et al.
8,888,306 B2 11/2014 Thomas et al.
9,222,654 B2 12/2015 Boyer et al.
9,261,270 B2 2/2016 Ruud et al.
9,261,271 B2 2/2016 Kinnune et al.
9,279,544 B1 3/2016 Dankelmann et al.
(Continued)

FOREIGN PATENT DOCUMENTS

EP 2162674 B1 4/2017
KR 101406244 B1 6/2014

*Primary Examiner* — Rajarshi Chakraborty
*Assistant Examiner* — Hana S Featherly
(74) *Attorney, Agent, or Firm* — Mark Terry

(57) ABSTRACT

A dual extrusion system for an LED light fixture comprises a first extrusion and a second extrusion. The first extrusion has a channel shape and dimensioned to enable underground installation. The first extrusion includes a gutter on an exterior surface, used for connecting multiple first extrusions. The first extrusion also includes multiple flanges on either side of the exterior for stabilizing first extrusion in the ground. The first extrusion also includes interior flanges on either side for providing a floor to receive the second extrusion. The system also provides a second extrusion comprising a channel that is placed within the first extrusion. The second extrusion includes free edges extending along a top brim. Free edges hold a plastic cover. The second extrusion also includes exterior flanges for engaging with interior flanges of first extrusion. The second extrusion also has flanges that create a floor to retain LED strips.

18 Claims, 9 Drawing Sheets

(56) References Cited

U.S. PATENT DOCUMENTS

| | | | |
|---|---|---|---|
| 9,404,634 | B2 | 8/2016 | Wilcox et al. |
| 9,512,984 | B2 | 12/2016 | Tessnow et al. |
| 9,933,123 | B2 | 4/2018 | Ladstatter |
| 9,952,372 | B2 | 4/2018 | Wilcox et al. |
| 10,151,435 | B2 | 12/2018 | Pearson et al. |
| 10,295,159 | B2 | 5/2019 | McCarthy et al. |
| 10,393,360 | B2 | 8/2019 | Bailey et al. |
| 10,724,719 | B1 | 7/2020 | Heredia |
| 2003/0021116 | A1 | 1/2003 | Miller |
| 2009/0168419 | A1 | 7/2009 | Daimon |
| 2011/0286207 | A1 | 11/2011 | Chan et al. |
| 2013/0308303 | A1 | 11/2013 | Greenholt et al. |
| 2014/0226316 | A1 | 8/2014 | Medendorp, Jr. et al. |
| 2014/0254145 | A1* | 9/2014 | Lee ..... F21V 29/508 362/218 |
| 2016/0076746 | A1 | 3/2016 | Porciatti |
| 2017/0205567 | A1 | 7/2017 | Tarsa et al. |
| 2018/0245754 | A1 | 8/2018 | Gensler et al. |
| 2018/0259142 | A1 | 9/2018 | Eddins |

* cited by examiner

DUAL EXTRUSION SYSTEM FOR LED LIGHT FIXTURE

CROSS-REFERENCE TO RELATED APPLICATIONS

This patent application claims priority to foreign patent application number 008123244-0007 filed on Aug. 17, 2020 with the European Intellectual Property Office, foreign patent application number 008123244-0008 filed on Aug. 17, 2020 with the European Intellectual Property Office, and foreign patent application number 008123244-0009 filed on Aug. 17, 2020 with the European Intellectual Property Office. The subject matter of foreign patent application numbers 008123244-0007, 008123244-0008, and 008123244-0009 are herein incorporated by reference in their entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The claimed subject matter relates to home furnishings and equipment, and more specifically relates to lighting fixtures.

BACKGROUND

The following background information presents examples of specific aspects of the prior art (e.g., without limitation, approaches, facts, or common wisdom) that, while expected to be helpful to further educate the reader as to additional aspects of the prior art, is not to be construed as limiting the claimed embodiments, or any embodiments thereof, to anything stated or implied therein or inferred thereupon.

A lighting fixture, or luminaire, is an electrical device containing an electric lamp that provides illumination. Lighting fixtures have a fixture body and one or more lamps. In the case of light-emitting diode (LED) fixtures, the lamps are hard-wired in place. Typically, lighting extrusions are materials that are formed to produce a specific cross-sectional profile for a lighting fixture. Such extrusions can be created specifically to fit the desired shape of the light and enable a designer to easily place lights exactly where they are required without the need for larger, more obtrusive, traditional light fixtures.

Lighting extrusions are elongated pieces of material with a consistent cross sectional profile. In many instances, these are elongated aluminum extrusions with a space for holding LED lights that span the length of the troffer. Troffers may be mounted to or suspended from ceilings, walls, floors, etc. In many cases, the extrusions are recessed into the ceiling, with the back side of the extrusion protruding into the ceiling.

Other proposals have involved lighting fixture aluminum extrusions for retaining an LED strip. The problem with these extrusions is that they do not enable easy installation below the surface of the ground. Also, the extrusions do not securely retain the LED strip and associated circuitry. Further, the extrusions do not allow for easy maintenance and upkeep of the device. Even though the above cited lighting fixture aluminum extrusions meets some of the needs of the market, the above-noted drawbacks lessen the usability and user-friendliness of the existing devices.

As a result of the previously recognized issues, a need exists for more efficient methods and systems for installing and maintaining LED lighting fixtures in different situations.

BRIEF SUMMARY

Illustrative embodiments of the disclosure are generally directed to a dual extrusion system for an LED light fixture. The dual extrusion system for an LED light fixture comprises a first extrusion that resides partially underground, and a corresponding second extrusion that detachably resides inside the first extrusion while retaining an LED strip.

In one non-limiting embodiment, the first extrusion defines a channel that is configured to be placed within the ground. Further, the first extrusion includes at least one gutter on an exterior surface. The gutter connects two instances of the first extrusion. The first extrusion also includes at least two flanges on either side of the exterior surface. The at least two flanges are configured for engaging with the ground around the at least two flanges. The first extrusion also includes at least two interior flanges on either side of an interior surface. The interior flanges are configured for providing a floor to receive a second extrusion.

In other embodiments, the dual extrusion system for LED light fixture also has a second extrusion. The second extrusion defines a channel that is configured to be placed within the first extrusion. The second extrusion includes free edges along a top brim. The free edges are configured for holding a plastic cover. The second extrusion also includes at least two exterior flanges on either side of an exterior surface of the second extrusion. The at least two exterior flanges of the second extrusion are configured for engaging with the interior flanges of the first extrusion, so as to secure the second extrusion within the first extrusion. The second extrusion also has at least two flanges on either side of an interior surface of the second extrusion. The at least two flanges of the second extrusion are configured for providing a floor used to hold an LED strip.

Additional aspects of the claimed subject matter will be set forth in part in the description which follows, and in part will be obvious from the description, or may be learned by practice of the claimed subject matter. The aspects of the claimed subject matter will be realized and attained by means of the elements and combinations particularly pointed out in the appended claims. It is to be understood that both the foregoing general description and the following detailed description are exemplary and explanatory only and are not restrictive of the disclosed subject matter, as claimed.

BRIEF DESCRIPTION OF THE DRAWINGS

The accompanying drawings, which are incorporated in and constitute part of this specification, illustrate embodiments of the claimed subject matter and together with the description, serve to explain the principles of the claimed subject matter. The embodiments illustrated herein are presently preferred, it being understood, however, that the claimed subject matter is not limited to the precise arrangements and instrumentalities shown, wherein:

Like reference numerals refer to like parts throughout the various views of the drawings.

DETAILED DESCRIPTION

Figure 1:
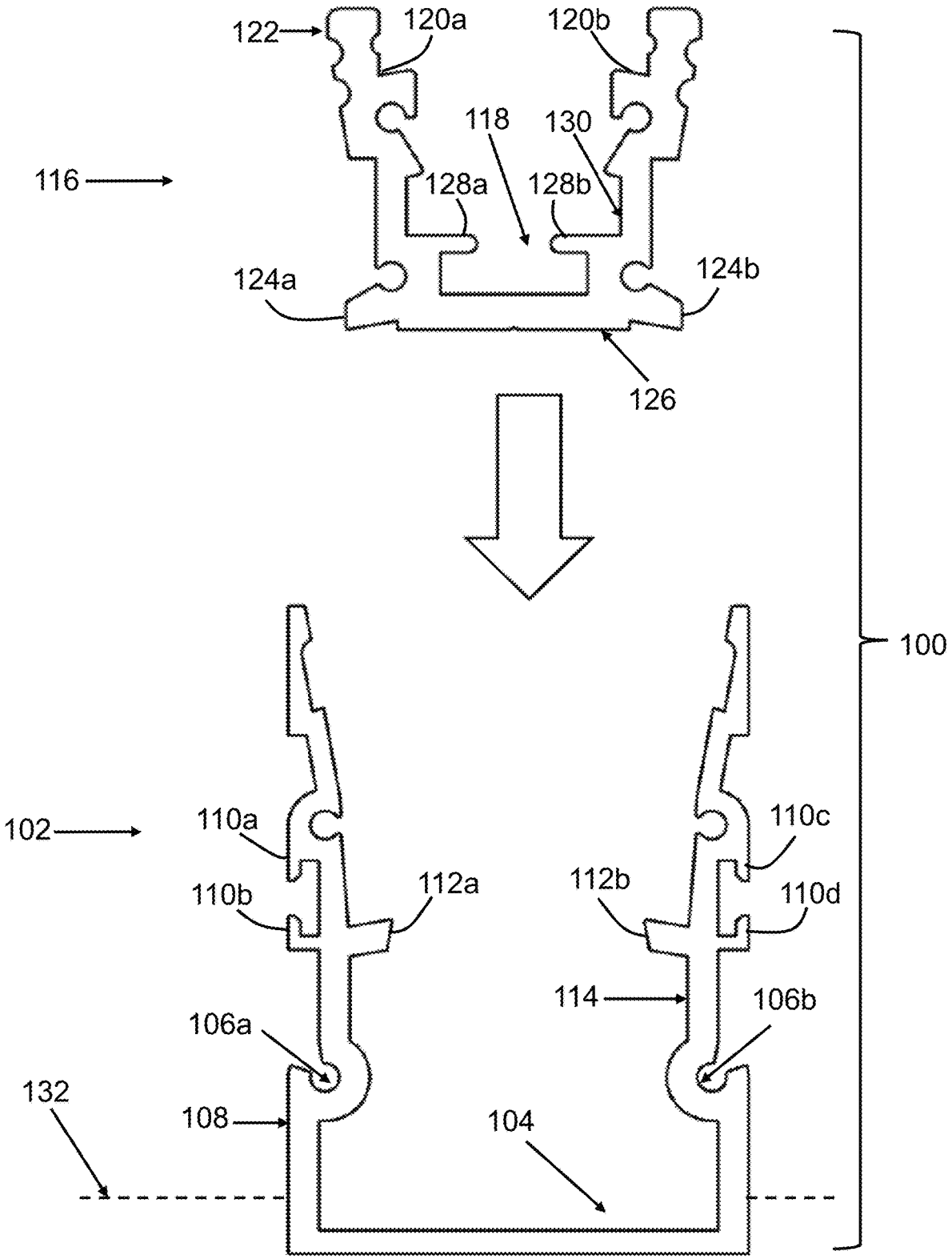
FIG. 1 illustrates a front view of an exemplary dual extrusion system for an LED light fixture, showing a first extrusion and a second extrusion separated, in accordance with an exemplary embodiment.

The disclosed embodiments improve upon the issues identified within the prior art by providing a system that allows for quick and easy installation of an LED lighting fixture in the ground, due to the use of a dual extrusion system. Additionally, the dual extrusion system of the claimed embodiments allow for efficient and speedy maintenance and upkeep of the device, since only the top extrusion need be opened and/or removed for proper maintenance. Also, the dual extrusion system of the claimed embodiments provide a space for securely retaining the LED strip and associated circuitry. Therefore, the disclosed embodiments reduce the time necessary for installing said LED lighting fixtures in the ground, as well as the maintenance thereof. The disclosed embodiments also facilitate an easier and less arduous installation and maintenance process.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the claimed embodiments as oriented in the figures. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A dual extrusion system for LED light fixture is referenced in FIGS. 1-19. The dual extrusion system for LED light fixture, hereafter "system" provides a unique lighting design having two extrusions in a stacked arrangement, and partially buried underground while retaining an LED strip. The system includes a first aluminum extrusion configured to be placed at least partially below the ground, and a corresponding second aluminum extrusion residing inside the first extrusion, and retaining an LED light fixture inside. The first and second extrusions include an aesthetic arrangement of channels, flanges, gutters, and free edges that work together to mount under the ground, while also securely retaining electrical circuitry 500 and an LED strip 602 that illuminates from within the extrusions.

Figure 2:
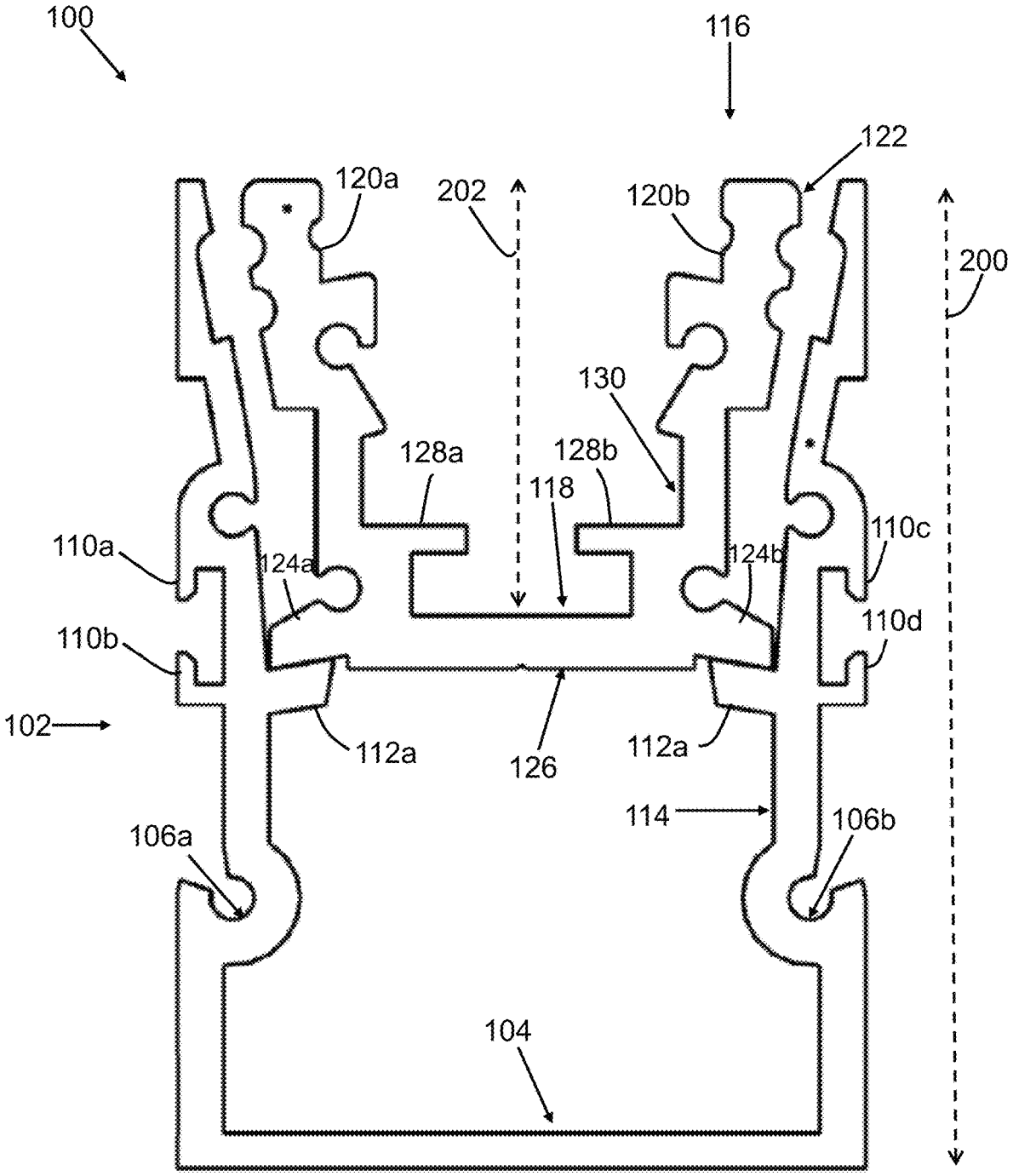
FIG. 2 illustrates a front view of the dual extrusion system for an LED light fixture shown in FIG. 1, showing a first extrusion and a second extrusion coupled together, in accordance with an exemplary embodiment.

As referenced in FIG. 1, the system comprises a first extrusion 102 and a corresponding second extrusion 116. The first extrusion 102 is configured to provide a supportive framework beneath the ground; and the second extrusion resides inside the first extrusion in a stacked relationship, while also retaining an LED strip and associated circuitry. For example, FIG. 2 shows the second extrusion 116 coupled with the first extrusion 102. In some embodiments, the first extrusion 102 has a first length 200 that is longer than a second length 202 of the second extrusion 116. In one non-limiting embodiment, the first and second extrusions 102, 116 comprise an aluminum material. However, in other embodiments, different materials may be used, including heat dispersing metals and polymers; and rust-resistant materials and coatings.

Looking again at FIG. 1, the first extrusion 102 defines a channel 104 that is sized and dimensioned for introduction beneath the surface of the ground 132. The channel 104 may form a U-shape. However, in other embodiments, a V-shape, or a square-shape may also be used. The channel 104 has an open face that orients upwardly, away from the ground.

In other embodiments, the first extrusion 102 comprises at least one gutter 106*a*, 106*b*. The gutter may include a pair of opposing gutters 106*a*, 106*b* projecting from an exterior surface 108 of the first extrusion 102. In one possible embodiment, the at least one gutter defines a circular shape that is sized and dimensioned to receive a fastener. The at least one gutter is configured to connect two instances of the first extrusion. For example, two adjacent first extrusions can be tied together in a lateral arrangement through use of the gutter.

In some embodiments, the first extrusion 102 also comprises at least two flanges 110*a*, 110*b*, 110*c*, 110*d* that are disposed on either side of the exterior surface 108. The at least two flanges 110*a-d* are configured for engaging with the ground 132, around the at least two flanges 110*a-d*. Because the first extrusion is configured to be partially buried under the ground 132, the flanges 110*a-d* project laterally from the first extrusion to provide lateral stability, anchoring into the ground 132.

The first extrusion 102 also comprises at least two interior flanges 112*a*, 112*b* that project out from either side of an interior surface 114 of the first extrusion. The at least two interior flanges 112*a-b* are configured for providing a floor for a second extrusion 116. The interior flanges 112*a-b* sloped upwardly to prevent the second extrusion 116 from slipping off the first extrusion 102. In alternative embodiments, a non-slip layer (not shown) can be placed on the interior flanges 112*a-b* to restrict slippage by the second extrusion 116.

As discussed above, a second extrusion 116, having generally smaller dimensioned than the first extrusion 102, resides inside the channel 104 of the first extrusion. Similar to the first extrusion 102, the second extrusion 116 forms a channel 118 configured to be placed within the first extrusion. The channel 118 formed in the second extrusion 116 may have a U-shape to conform to the channel 104 of the first extrusion. However, in other embodiments, a V-shape may also be used.

Figures 5, 6, 7:
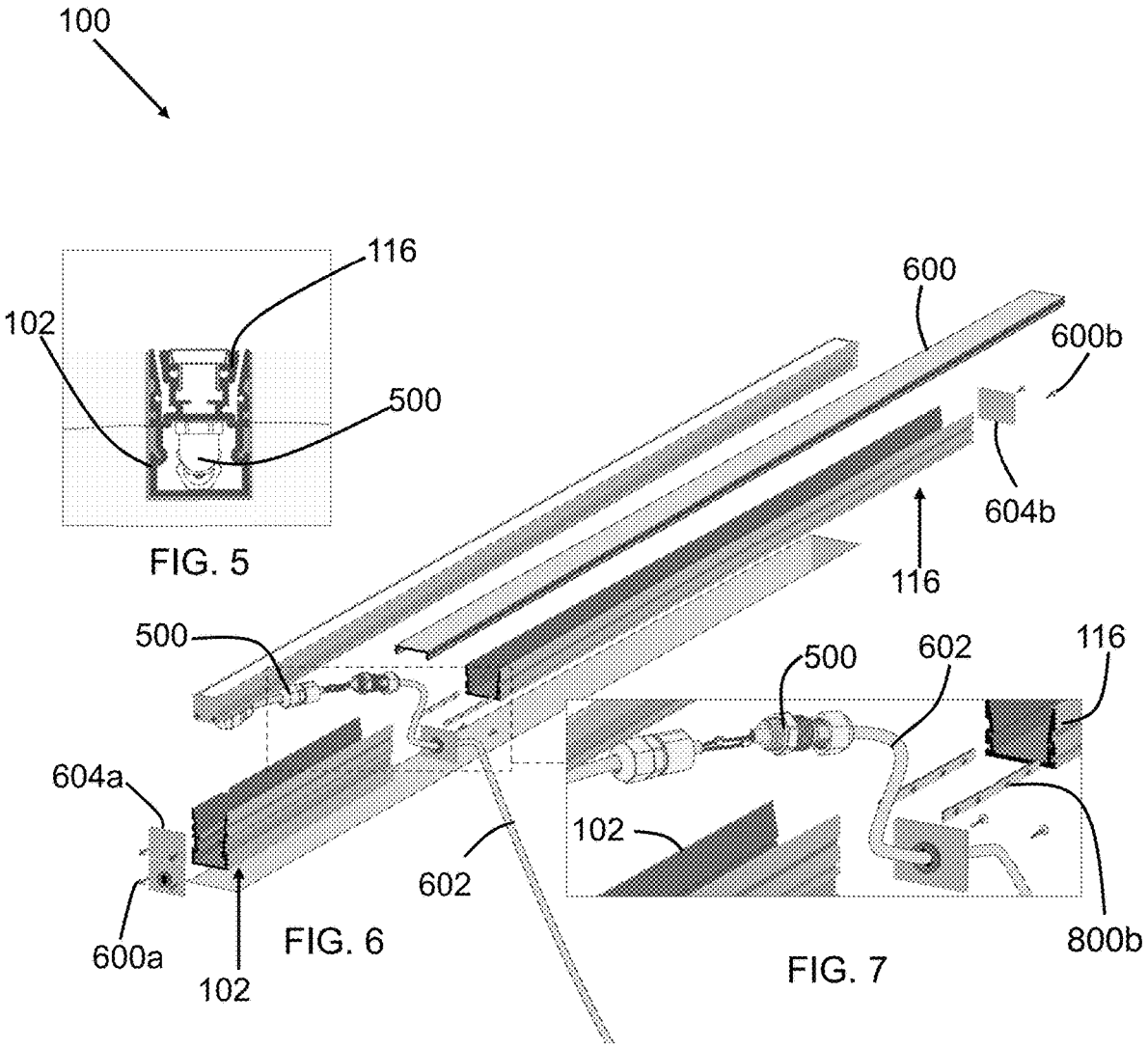
FIG. 5 illustrates a front view of an exemplary circuitry for an LED strip, in accordance with an exemplary embodiment.
FIG. 6 illustrates a blow-up view of an exemplary dual extrusion system for an LED light fixture, in accordance with an exemplary embodiment.
FIG. 7 illustrates a perspective view of an exemplary circuitry connected to an LED strip, in accordance with an exemplary embodiment.

In some embodiments, the second extrusion 116 defines multiple free edges 120*a*, 120*b*. The free edges 120*b* form along a top brim 122 of the second extrusion (see FIG. 1). In some embodiments, the free edges 120*a-b* are configured for holding a plastic cover 600. As shown in FIG. 6, the plastic cover 600 extends along the longitudinal of the second extrusion, resting on the top brim 122. The plastic cover can be a partially transparent cover that allows light from the LED strip 602 to pass, or serves as a color filter.

In some embodiments, the second extrusion 116 also comprises at least two exterior flanges 124*a*, 124*b* projecting from either side of an exterior surface 126 of the second extrusion. In one possible embodiment, the at least two exterior flanges 124*a-b* of the second extrusion define a sloped disposition. The exterior flanges 124*a-b* are configured for engaging with the at least two interior flanges 112*a-b* of the first extrusion. In alternative embodiments, the exterior flanges 124*a-b* and interior flanges 112*a-b* interlock in a snap-fit relationship, or through various mechanical fastening means known in the art. In this manner, the second extrusion secures firmly within the channel of the first extrusion.

In some embodiments, the second extrusion 116 also comprises at least two LED flanges 128*a*, 128*b* that project from either side of an interior surface 130 of the second extrusion 116. In one embodiment, the LED flanges are disposed horizontally relative to the longitudinal of the second extrusion. The LED flanges are configured for providing a floor for an LED strip 602 to reside therein. The LED strip allows the system 100 to illuminate from the ground surface, or partially beneath the ground.

Figure 3:
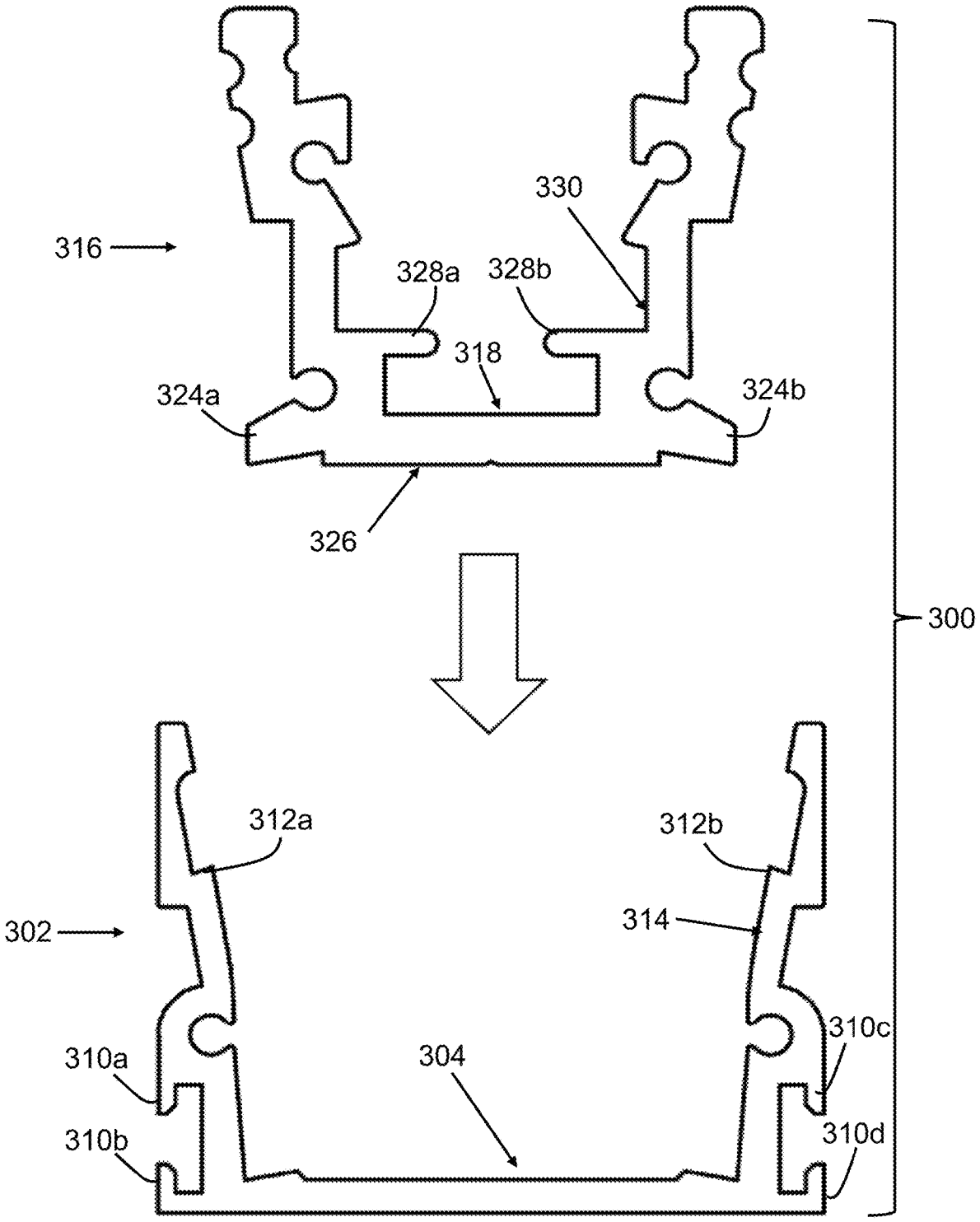
FIG. 3 illustrates a front view of an alternative embodiment of a dual extrusion system for an LED light fixture, showing a first extrusion and a second extrusion separated, in accordance with an exemplary embodiment.

In addition to the aforementioned system 100, the present disclosure also teaches an alternative dual extrusion system 300, shown in FIG. 3. In this system 300, a first extrusion 302 defines substantially smaller dimensions, including a lesser length 200, than disclosed above. As illustrated, the first extrusion 302 is configured to receive, and couple to a second extrusion 316. The first extrusion 302 defines a channel 304 that is configured to be placed within the ground 132. At least two flanges 310*a*, 310*b*, 310*c*, 310*d* on either side of the exterior surface enable secure placement into the ground.

In some embodiments, the at least two flanges 310*a-d* are configured for engaging with the ground for stabilizing the first extrusion 302. And similar to the aforementioned first extrusion 102, the alternative embodiment of the first extrusion 302 comprises at least two interior flanges 312*a*, 312*b* on either side of an interior surface 314 for providing a floor for the second extrusion 316. It is significant to note that the gutter 106*a*, 106*b* is not utilized in the shorter version of the first extrusion 302.

Figure 4:
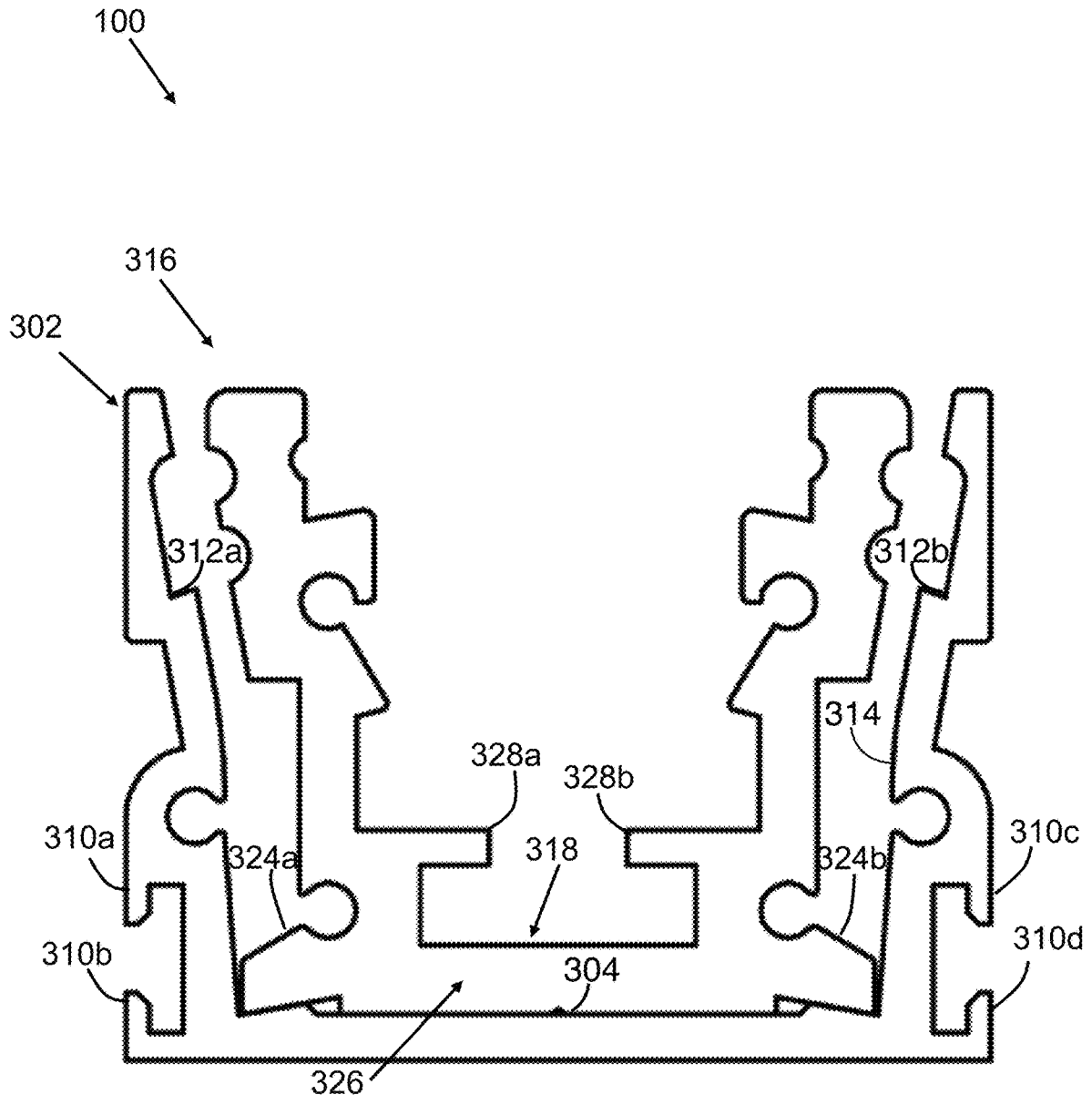
FIG. 4 illustrates a front view of the dual extrusion system for an LED light fixture shown in FIG. 3, showing a first extrusion and a second extrusion coupled together, in accordance with an exemplary embodiment.

Continuing with FIG. 4, the second extrusion 316 fits into the channel 304 of the first extrusion 302. Similar to the first extrusion 302, the second extrusion 316 forms a channel 318 configured to be placed within the first extrusion 302. The second extrusion 316 also comprises at least two LED flanges 328*a*, 328*b* on either side of an interior surface 330 of the second extrusion 316. The second extrusion 316 also comprises at least two exterior flanges 324*a*, 324*b* on either side of an exterior surface 326 of the second extrusion for engaging with the at least two interior flanges 312*a-b* of the first extrusion 302.

Looking now at FIG. 5, the system 100 may also provide a circuitry 500 that is operatively connected to the LED strip. In some embodiments, the circuitry 500 includes wiring, resistors, circuits, and other electronic components known in the art of lighting fixtures. The LED strip can be securely fastened to the sides of the second extrusion 116 in this manner.

In some embodiments, shown in FIG. 7, the channels 104, 118 of the first and second extrusions form multiple fastening holes 900*a*, 900*b* that are sized and dimensioned to enable passage of at least one fastener 600*a*, 600*b*. The fastening holes 900*a-b* are configured to enable connectivity between the first extrusion 102 to the second extrusion 116. The fasteners may include, without limitation, a threaded screw, a bolt, a nail, a magnet, an adhesive, and a mechanical snap-fit means.

Figure 8:
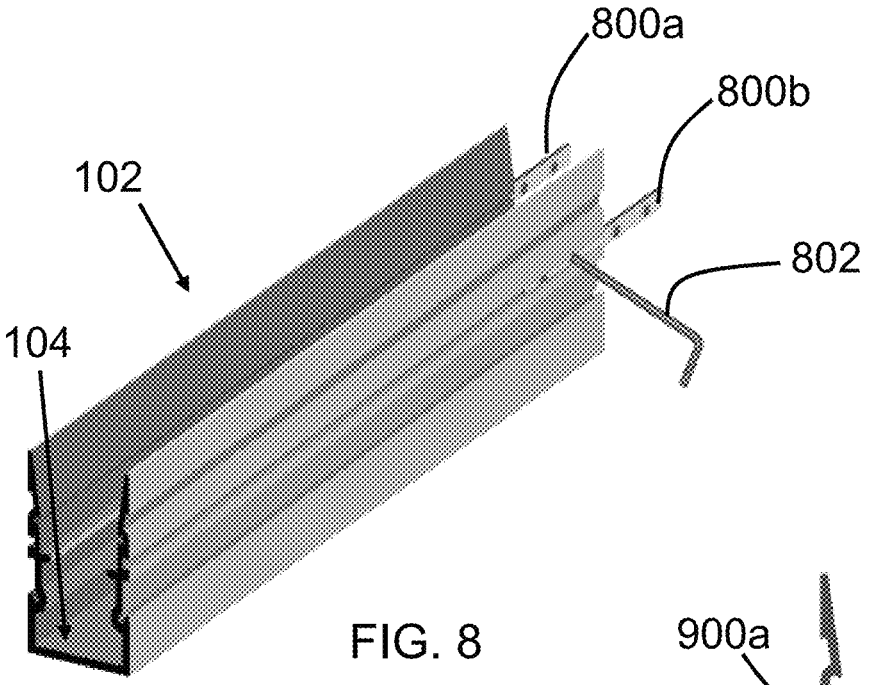
FIG. 8 illustrates a perspective view of an exemplary first extrusion with attached bracket, in accordance with an exemplary embodiment.

As shown in FIG. 8, a fastening tool 802 may be utilized to introduce the at least one fastener into the fastening holes.

Figure 9:
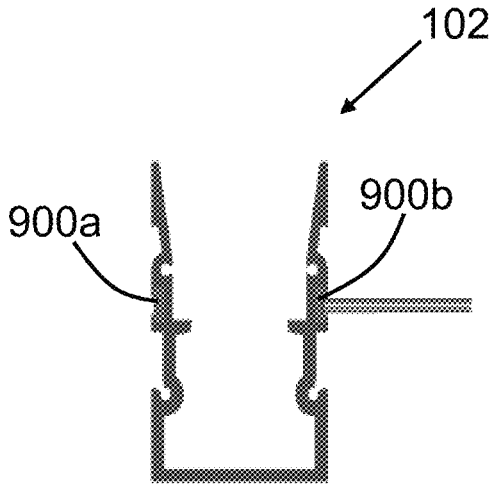
FIG. 9 illustrates a front view of the first extrusion, showing a fastening tool introducing a fastener into the extrusion, in accordance with an exemplary embodiment.

The fastening tool 802 can be a screw driver, an Allen wrench, a torque screw, and other fastening means known in the art. The fastening tool 802 rotatably drives the fastener into the side of the channel, through the first and/or second extrusions 102, 116. For example, FIG. 9 illustrates a front view of the first extrusion 102, showing a fastening tool 802 introducing a fastener into the first extrusion 102.

Figure 10:
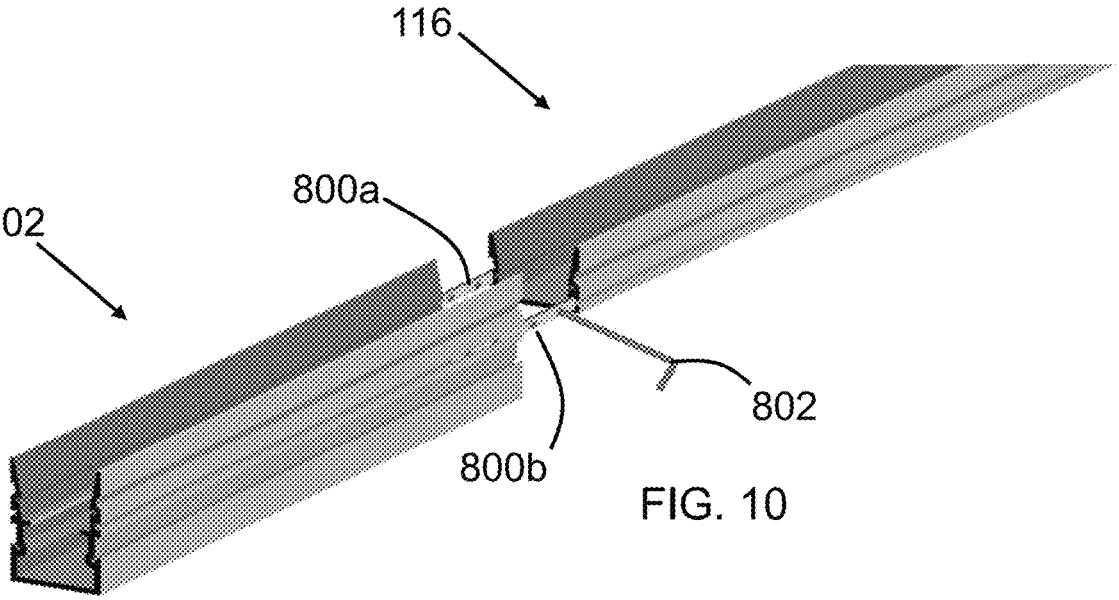
FIG. 10 illustrates a perspective view of the first extrusion and the second extrusion aligned for coupling together, showing a fastening tool introducing a fastener into the extrusion, in accordance with an exemplary embodiment.
Figure 11:
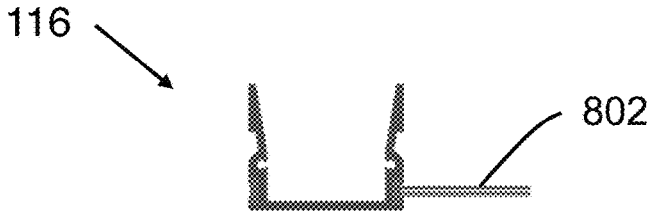
FIG. 11 illustrates a front view of the first and second extrusions being fastened together, in accordance with an exemplary embodiment.
Figure 12:
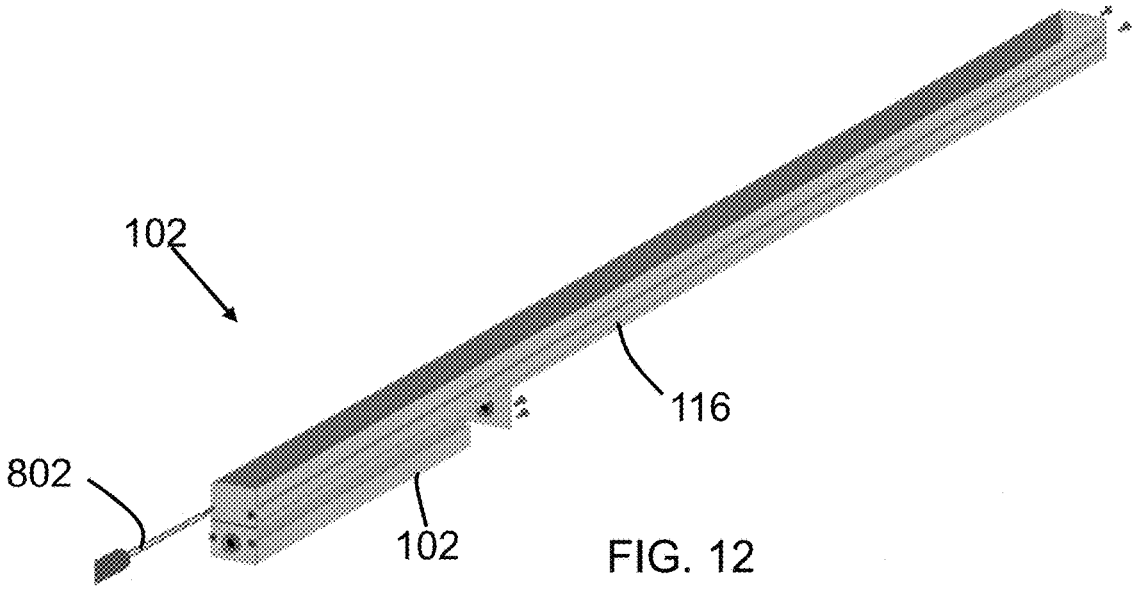
FIG. 12 illustrates a perspective view of the first extrusion and second extrusions coupled together, in accordance with an exemplary embodiment.

As FIG. 10 illustrates, the system 100 further comprises at least one bracket 800*a*, 800*b* that is configured to help or facilitate aligning the first extrusion 102 with the second extrusion 116. The bracket can be a linear flat bar with apertures that align with the fastening holes 900*a-b* in the first extrusion 102. This allows for a telescoping relationship between the first and second extrusions 102, 116. Once the extrusions 102, 116 align in this manner, the fastener can be driven through the fastening holes to secure the desired alignment (see FIG. 11). In one possible embodiment, the system comprises at least one end plate 604*a*, 604*b* that is configured to fasten to the termini of the connected first and second extrusions. FIG. 12 shows the end plates being installed through fasteners and the fastening tool.

Figure 13:
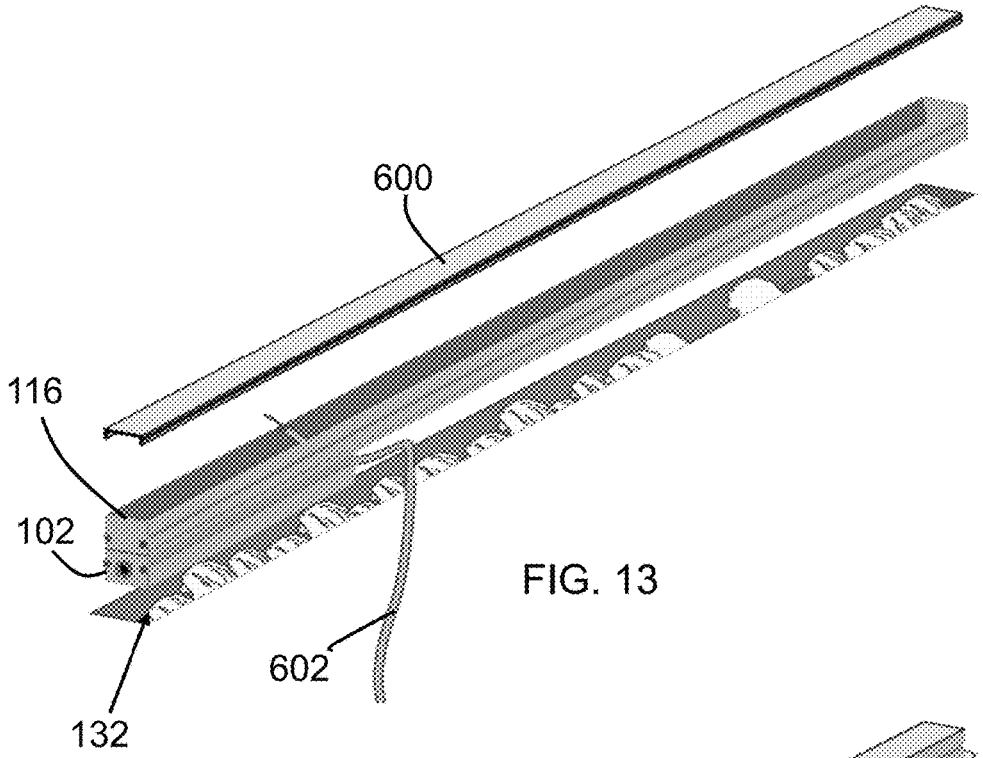
FIG. 13 illustrates a perspective view of the first extrusion being introduced below the surface of the ground, in accordance with an exemplary embodiment.
Figure 14:
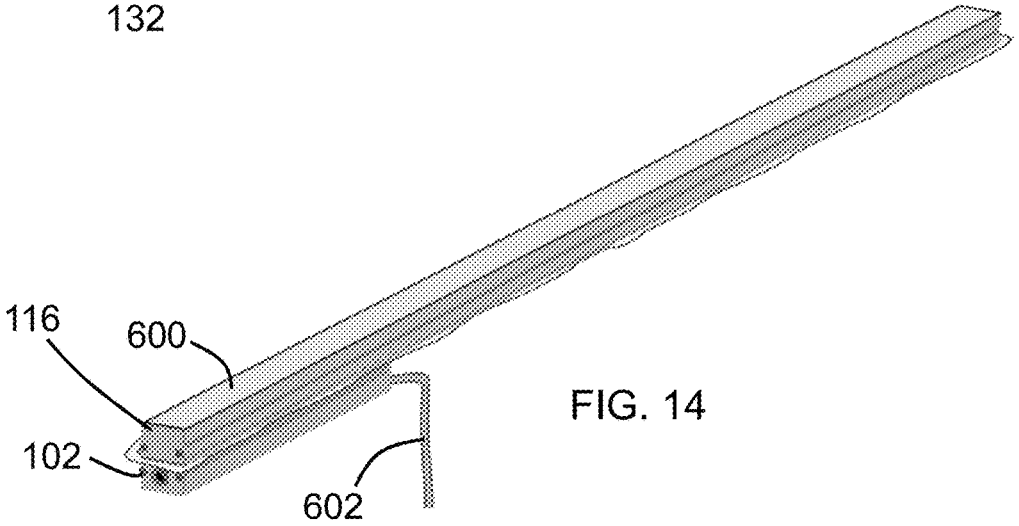
FIG. 14 illustrates a perspective view of the first extrusion and the second extrusion in the ground and operational with the LED strip extending therefrom, in accordance with an exemplary embodiment.

In operation, the first extrusion 102 is placed on, or below the surface of the ground 132 (FIG. 13). The channel 104 is fitted into the opening in the ground 132, forming a snug relationship therebetween. The exterior flanges 110*a-d* serve to stabilize the first extrusion horizontal with the ground. Once the first extrusion 102 is established, the second extrusion 116 aligns with the first extrusion, such that both channels 104, 118 align. The second extrusion is then set into the first extrusion 102, forming a unitary light fixture (see FIG. 14).

Figure 15:
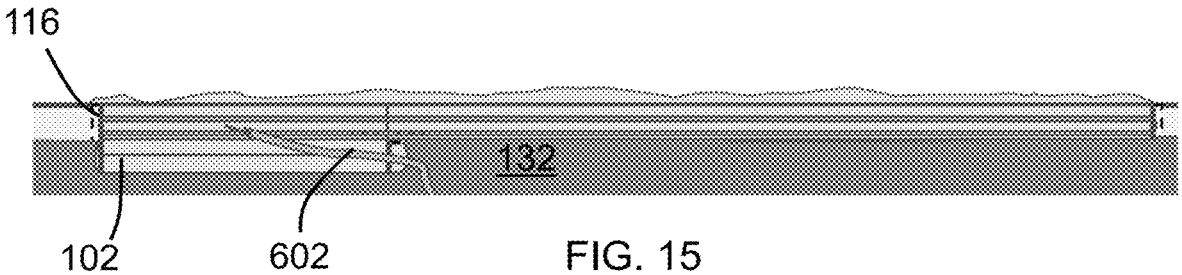
FIG. 15 illustrates a sectioned side view of the first extrusion and the second extrusion in the ground with the LED strip extending therefrom, in accordance with an exemplary embodiment.
Figure 16:
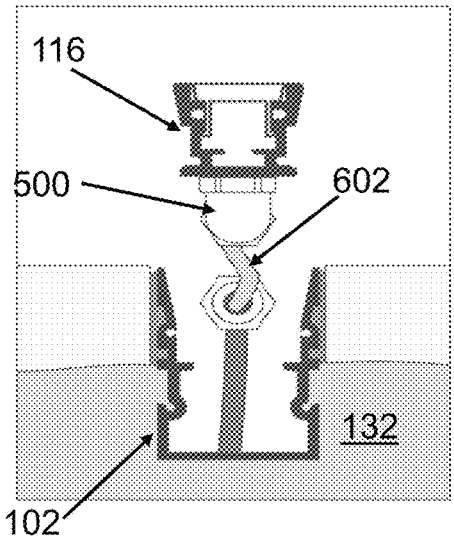
FIG. 16 illustrates a front view of the circuitry being aligned for introduction into the sidewalls of the second extrusion, in accordance with an exemplary embodiment.
Figure 17:
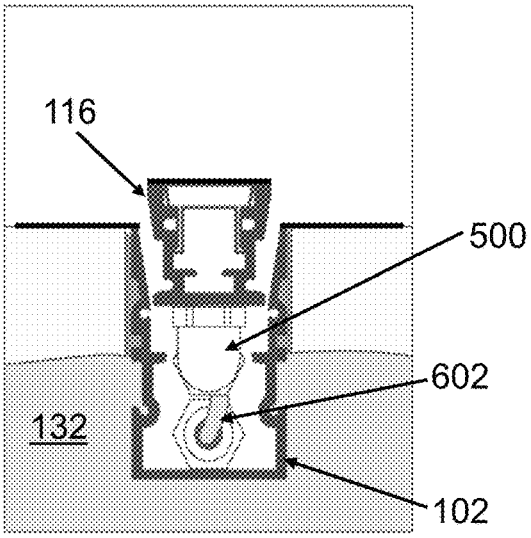
FIG. 17 illustrates a front view of the circuitry being introduced into the sidewalls of the second extrusion, in accordance with an exemplary embodiment.
Figure 18:
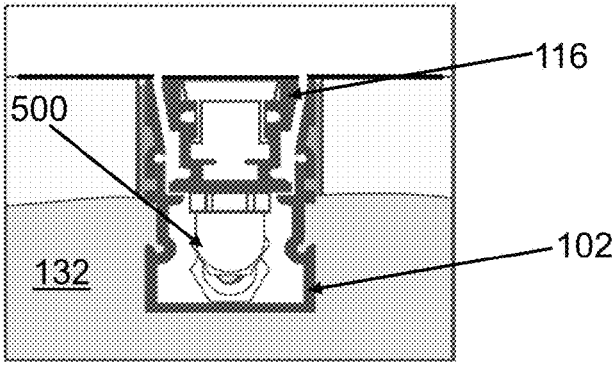
FIG. 18 illustrates a front view of the circuitry fully installed into the sidewalls of the second extrusion, in accordance with an exemplary embodiment.
Figure 19:
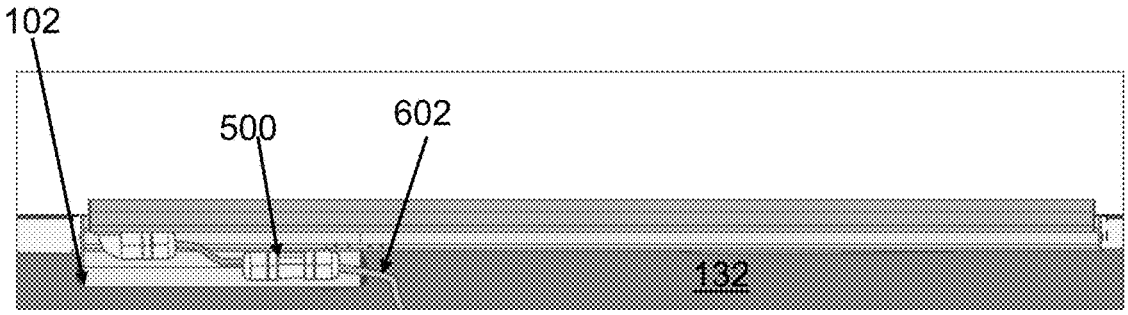
FIG. 19 illustrates a sectioned side view of the first extrusion and the second extrusion in the ground and operational, in accordance with an exemplary embodiment.

FIG. 15 shows a sectioned side view of the system 100 partially buried beneath the ground, showing the LED strip 602 oriented for illuminating from the second extrusion 116. Continuing with the illumination means, the circuitry 500 can be interchanged/replaced while the extrusions 102, 116 is established into the ground 132. FIGS. 16-17 reference the circuitry 500 being introduced into the sidewalls of the second extrusion 116, with FIG. 18 showing the fully installed circuitry 500 and LED strip 602. After the circuitry 500 and LED strip 602 is placed therein, the illumination can be controlled through an electrical switch. Finally, FIG. 19 shows a side sectioned view of the system full installed and operational to illuminate.

These and other advantages of the claimed embodiments will be further understood and appreciated by those skilled in the art by reference to the following written specification, claims and appended drawings.

Because many modifications, variations, and changes in detail can be made to the described preferred embodiments described herein, it is intended that all matters in the foregoing description and shown in the accompanying drawings be interpreted as illustrative and not in a limiting sense. Thus, the scope of the claimed embodiments should be determined by the appended claims and their legal equivalence.

Embodiments herein, for example, are described above with reference to block diagrams and/or operational illustrations of methods and systems, according to said embodiments. The functions/acts noted in the blocks may occur out of the order as described. For example, two steps described in succession may in fact be executed substantially concurrently or the steps may sometimes be executed in the reverse order, depending upon the functionality/acts involved.

While certain embodiments have been described, other embodiments may exist. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A dual extrusion system for a LED light fixture, the dual extrusion system comprising: a) a first extrusion comprising a first channel placed within the ground, the first extrusion comprising: at least one gutter disposed on an exterior surface of the first extrusion, the at least one gutter to connect two instances of the first extrusion; at least two flanges on either side of the exterior surface, the at least two flanges engaging with the ground around the at least two flanges; and at least two interior flanges on either side of an interior surface of the first extrusion, the at least two interior flanges providing a floor for a second extrusion; b) the second extrusion comprising a second channel placed within the first extrusion, the second extrusion comprising: multiple free edges disposed along a top brim, the multiple free edges holding a plastic cover; at least two exterior flanges on either side of an exterior surface of the second extrusion, the at least two exterior flanges of the second extrusion engaging with the at least two interior flanges of the first extrusion, so as to secure the second extrusion within the first extrusion; and at least two LED flanges on either side of an interior surface of the second extrusion, the at least two LED flanges of the second extrusion providing a floor for an LED strip, wherein the at least two LED flanges are disposed horizontally relative to the longitudinal of the second extrusion.

2. The system of claim 1, wherein the first extrusion comprises an aluminum material.

3. The system of claim 1, wherein the second extrusion comprises an aluminum material.

4. The system of claim 1, wherein the first extrusion has a first length that is longer than a second length of the second extrusion.

5. The system of claim 1, wherein the channel of the first extrusion defines a U-shaped configuration.

6. The system of claim 1, wherein the channel of the second extrusion defines a U-shaped configuration.

7. The system of claim 1, wherein the at least two exterior flanges of the second extrusion define a sloped disposition.

8. The system of claim 1, further comprising a circuitry operatively connected to the LED strip.

9. The system of claim 1, wherein the at least one gutter defines a circular shape.

10. The system of claim 1, wherein the first and second channels of the first and second extrusions form multiple fastening holes configured to enable passage of at least one fastener.

11. The system of claim 10, wherein the fastening holes connect the first extrusion to the second extrusion.

12. The system of claim 11, further comprising at least one bracket to help align the first extrusion with the second extrusion.

13. The system of claim 11, further comprising at least one end plate to fasten to the termini of the connected first and second extrusions.

14. The system of claim 10, further comprising a fastening tool to introduce the at least one fastener into the fastening holes.

15. A dual extrusion system for a LED light fixture, the dual extrusion system comprising: a) an aluminum first extrusion comprising a first U-shaped channels placed within the ground, the first U-shaped channels of the first extrusion forming multiple fastening holes to enable passage of at least one fastener, the first extrusion comprising: at least one gutter disposed on an exterior surface of the first extrusion, the at least one gutter to connect two instances of the first extrusion; at least two flanges on either side of the exterior surface, the at least two flanges engaging with the ground around the at least two flanges; and at least two interior flanges on either side of an interior surface of the first extrusion, the at least two interior flanges providing a floor for an aluminum second extrusion; b) the aluminum second extrusion comprising a second U-shaped channel to be placed within the first extrusion, the second U-shaped channels of the second extrusion forming multiple fastening holes to enable passage of at least one fastener, the second extrusion comprising: multiple free edges disposed along a top brim, the multiple free edges holding a plastic cover; at least two exterior flanges on either side of an exterior surface of the second extrusion, the at least two exterior flanges of the second extrusion engaging with the at least two interior flanges of the first extrusion, so as to secure the second extrusion within the first extrusion; at least two LED flanges on either side of an interior surface of the second extrusion, the at least two LED flanges of the second extrusion providing a floor for an LED strip; c) a circuitry operatively connected to the LED strip; d) at least one bracket to facilitate aligning the first extrusion with the second extrusion; and e) at least one end plate to fasten to a termini of the first and second extrusions, wherein the at least two LED flanges are disposed horizontally relative to the longitudinal of the second extrusion.

16. The system of claim 15, wherein the first extrusion has a first length that is longer than a second length of the second extrusion.

17. The system of claim 15, wherein the at least two LED flanges are disposed horizontally relative to the longitudinal of the second extrusion.

18. A dual extrusion system for a LED light fixture, the system consisting of: a) an aluminum first extrusion comprising first U-shaped channels to be placed within the ground, the first U-shaped channels of the first extrusion forming multiple fastening holes to enable passage of at least one fastener, the first extrusion comprising: at least one gutter disposed on an exterior surface of the first extrusion, the at least one gutter to connect two instances of the first extrusion; at least two flanges on either side of the exterior surface, the at least two flanges engaging with the ground around the at least two flanges; and at least two interior flanges on either side of an interior surface of the first extrusion, the at least two interior flanges providing a floor for an aluminum second extrusion; b) the aluminum second extrusion comprising second U-shaped channel placed within the first extrusion, the second U-shaped channels of the second extrusion forming multiple fastening holes to enable passage of at least one fastener, the second extrusion comprising: multiple free edges disposed along a top brim, the multiple free edges holding a plastic cover; at least two exterior flanges on either side of an exterior surface of the second extrusion, the at least two exterior flanges of the second extrusion engaging with the at least two interior flanges of the first extrusion, so as to secure the second extrusion within the first extrusion, the at least two exterior flanges of the second extrusion define a sloped disposition; at least two LED flanges on either side of an interior surface of the second extrusion, the at least two LED flanges of the second extrusion for providing a floor for an LED strip, the at least two LED flanges being disposed horizontally relative to the longitudinal of the second extrusion; c) a circuitry operatively connected to the LED strip; d) at least one bracket to facilitate aligning the first extrusion with the second extrusion; and e) at least one end plate to fasten to a termini of the first and second extrusions.

* * * * *